US005704663A

United States Patent [19]

Clay, Jr.

[11] Patent Number: 5,704,663

[45] Date of Patent: Jan. 6, 1998

[54] SELF-TIGHTENING SIDE LOCK FOR A ROLL-UP DOOR

[75] Inventor: Roy T. Clay, Jr., Snyder, N.Y.

[73] Assignee: Whiting Roll-Up Door Mfg. Corp., Akron, N.Y.

[21] Appl. No.: 725,273

[22] Filed: Oct. 2, 1996

Related U.S. Application Data

[63] Continuation of Ser. No. 371,831, Jan. 12, 1995, abandoned.

[51] Int. Cl.[6] ..... E05C 3/06

[52] U.S. Cl. ..... 292/198; 292/122; 292/341.3; 292/DIG. 32; 292/DIG. 36

[58] Field of Search ..... 292/198, 121–128, 292/341.13, DIG. 32, DIG. 36, 240, 24, 190, 219

[56] References Cited

U.S. PATENT DOCUMENTS

| | | | |
|---|---|---|---|
| 3,740,978 | 6/1973 | Smith et al. | 292/DIG. 36 |
| 3,894,761 | 7/1975 | Brennan, Jr. | 292/225 |
| 3,958,822 | 5/1976 | Gerner | 292/DIG. 36 |
| 4,782,674 | 11/1988 | Johnson | 292/DIG. 3 |
| 4,830,415 | 5/1989 | Nelson | 292/DIG. 3 |
| 5,022,691 | 6/1991 | Clay, Jr. | 292/121 |

*Primary Examiner*—Rodney M. Lindsey
*Attorney, Agent, or Firm*—Phillips, Lytle, Hitchcock, Blaine & Huber LLP

[57] ABSTRACT

A self-tightening side lock (20) for a roll-up door includes a keeper (25) mounted on the jamb, and a latch member (26) pivotally mounted on a door panel. The latch member is selectively cooperable with a catch (30) to hold the door in a closed position. The latch member is biased to move in a counter-clockwise direction. The latch member is adapted to be moved in a clockwise direction, against the opposing bias or a spring 42, to an out-of-the-way position at which the displaced latch may pass by the catch. The latch member has a side cam surface (33) arranged to engage the catch (30) when the door is lowered and to cause the latch member to pivot in a clockwise direction toward the out-of-the-way position to allow the latch member to pass by the catch. The latch member also has an upper cam surface (34) arranged to engage the catch such that the counter-clockwise movement of the latch member will cause the door to be self-tightening. A notch (50) extends radially into the latch member from the upper cam surface adjacent the side cam surface. The notch member is so configured and arranged as to receive the catch and to prevent further pivotal movement of the latch member. The improved side lock will thwart the efforts of a would-be thief who might attempt to force the door upwardly with the upper cam surface engaging the catch.

15 Claims, 3 Drawing Sheets

SELF-TIGHTENING SIDE LOCK FOR A ROLL-UP DOOR

This application is a continuation of application Ser. No. 08/371,831 filed on Jan. 12, 1995 now abandoned.

TECHNICAL FIELD

The present invention relates generally to the field of upwardly-acting and roll-up doors typically found on trucks, trailers and the like, and, more particularly, to an improved self-tightening side lock for selectively holding such a door in its closed position.

BACKGROUND ART

Roll-up doors are ubiquitous. These doors are commonly found in garages, industrial buildings, and on trucks, trailers and other vehicles. In such doors, a pair of inwardly-facing inverted L-shaped tracks are typically mounted on a body (i.e., a static structure, the body of a vehicle, etc.). A plurality of series-connected panels are operatively mounted for guided articulated movement along the tracks between a lowered substantially-vertical position closing the access opening, and an overhead substantially-horizontal out-of-the-way position.

In some cases, the door, when moved to its closed position, is lockable to a keeper provided on the sill. In other situations, it is desirable to provide a lock between one or more of the sides of a door panel and the adjacent jambs.

One form of such a side lock has heretofore taken the shape of a butterfly-type latch mounted on the door and selectively engageable with a keeper mounted on the proximate jamb. Such prior art latch typically had a lower or side cam surface that was arranged to engage the keeper for automatically displacing the latch to an out-of-the-way position when the door was lowered. Such latch also had an upper arcuate cam surface that was adapted to pass beneath the keeper when the door was closed. This upper surface was outwardly- and upwardly-inclined in order that the closed door would be self-tightening during relative movement between the door and the jamb. While this inclined cam surface was clearly desired to provided the self-tightening feature, its engagement with the keeper also provided a type of inclined plane or wedge. Hence, an intruder could insert an appropriate lever, such as a crowbar or the like, beneath the door, and pry the door upwardly in an attempt to "jimmy" the door. Upon information and belief, and depending upon the angle of inclination of the upper cam surface, the door might possibly fail (i.e., could be opened by the intruder) by bowing the jamb outwardly such that the latch could pass by the keeper.

In an attempt to solve this problem, it has been proposed to use a hook-like member as a substitute for the butterfly-type latch member, and to use an improved keeper having a catch that would be selectively received in the concavity provided in the hook member. Thus, if an intruder attempted to "jimmy" the door, the catch member would be more firmly received in the crotch of the hook. This type of mechanism is shown in applicant's prior U.S. Pat. No. 5,022,691, the aggregate disclosure of which is hereby incorporated by reference. While this arrangement is structurally sound, it is somewhat expensive in that the parts are generally heavier and more substantial than those in the prior art. In addition, it has been found that the hook member and the keeper must be accurately positioned on the door and jamb, respectively. Another disadvantage is that, in some cases, the self-tightening feature is lost, and the door may "dance" upwardly and downwardly as the vehicle moves down the street.

Accordingly, it would be generally desirable to provide an improved butterfly-type latch member that could be used with such a catch-containing keeper, that would be inexpensive to manufacture, but that would effectively prevent an intruder from attempting to defeat the lock.

DISCLOSURE OF THE INVENTION

With parenthetical reference to the corresponding parts, portions or surfaces of the disclosed embodiment, merely for purposes of illustration and not by way of limitation, the improvement broadly provides an improved self-tightening side lock mechanism (20) for a roll-up door (21) that is adapted to selectively close an opening bounded by a jamb (23) and a sill (24).

The improved side lock mechanism broadly includes a keeper (25) mounted on one of the jamb and door. The keeper has a catch (30) arranged in spaced relation to the jamb and sill. The improved mechanism also includes a latch member (26) pivotally mounted on the other of the jamb and door and selectively cooperable with the catch to hold the door in a closed or lowered position. The latch member is biased to move in one angular direction. The latch mechanism is adapted to be selectively moved in the opposite angular direction to an out-of-the-way position at which such displaced latch member may pass by the catch. The latch member has a side cam surface (33) arranged to engage the catch when the door is lowered, and arranged to cause the latch member to pivot in the other angular direction toward the out-of-the-way position to allow the latch member to pass by the catch as the door is lowered. The latch member also has an upper cam surface (34) arranged to engage the catch such that pivotal movement of the latch member in the one angular direction will cause the door to be self-tightening. A notch (50) extends into the latch member from the upper cam surface adjacent its intersection with the side cam surface. The notch is so configured and arranged as to remain in a non-interfering position during normal operation, but to receive the catch and to prevent pivotal movement of the latch member if one attempts to force the latched door upwardly; thereby to attempt to thwart the efforts of a would-be thief who might attempt to force the door to move upwardly with the upper cam surface engaging the catch.

Accordingly, the general object of the invention is to provide an improved side lock for a roll-up door.

Another object is to provide an improved side lock for a roll-up door that is self-tightening and inexpensive to manufacture.

Still anther object is to provide an improved self-tightening side lock for a roll-up door that contains a means or mechanism of preventing a would-be intruder from attempting to force the door upwardly relative to the jamb when the lock is engaged.

These and other objects and advantages will come apparent from the forgoing and ongoing written specification, the drawings, and the appended claims.

BRIEF DESCRIPTIONS OF THE DRAWINGS

DESCRIPTION OF THE PREFERRED EMBODIMENTS

Figure 1:
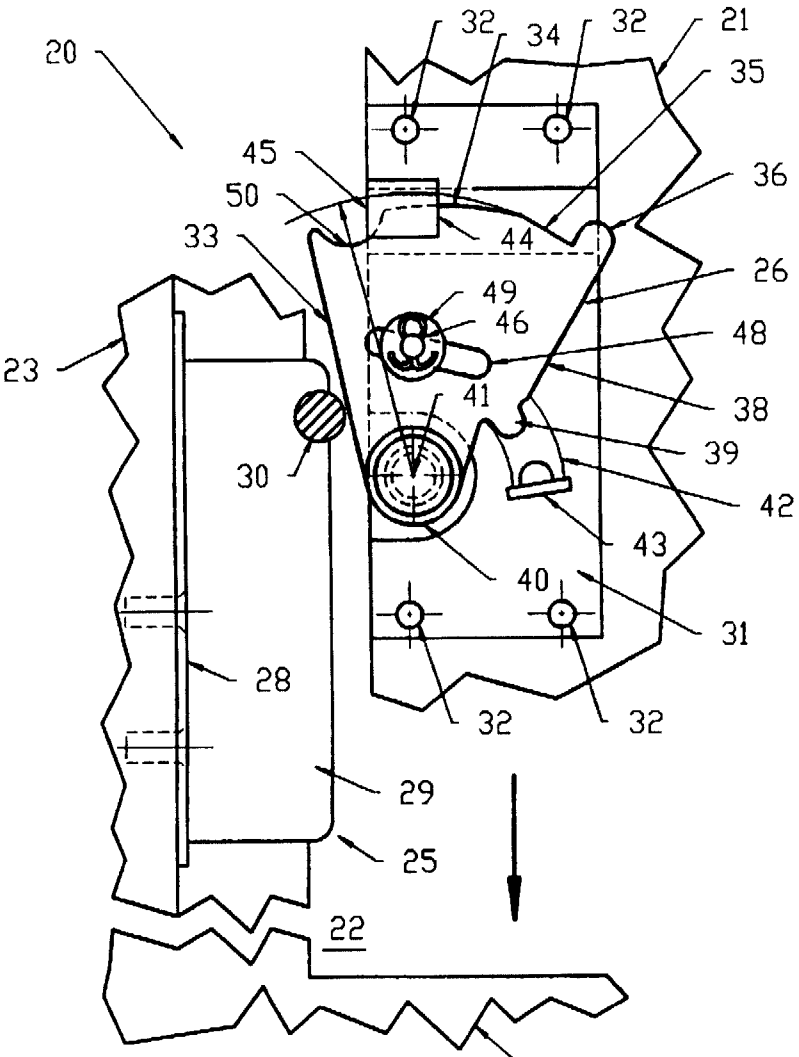
FIG. 1 is a fragmentary view, partly in elevation and partly in cross-section, showing the improved side lock mechanism as being mounted on a door to engage a catch provided on a jamb-mounted keeper, this view showing the side cam surface of the latch member as engaging the catch when the door is lowered.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, the present invention broadly provides an improved self-tightening side lock mechanism, generally indicated at 20, for a roll-up door, a fragmentary portion of which is indicated at 21. This door is adapted to selectively close an opening 22 partially bounded by a left side jamb 23 and a lower sill 24. The improved mechanism broadly includes a keeper, generally indicated at 25, mounted on the jamb, and a latch member generally indicated at 26, mounted on the door. While the keeper is shown as being mounted on the jamb and the latch member is shown as being mounted on the door, the positions of these two members could possibly be reversed in some instances.

The keeper 25 is substantially shown in the aforesaid U.S. Pat. No. 5,022,691. This keeper includes a vertically-elongated plate 28 secured to the jamb, and a plurality of vertically-elongated plate-like members, one of which is indicated 29, extending perpendicularly therefrom toward the door. A horizontal cylindrical catch 30 is operatively mounted on the two plates 29, 29 in spaced relation to the side jamb 23 and to the lower sill 24.

In the preferred embodiment, latch member 26 is shown as being pivotally mounted on a vertically-elongated plate-like member 31. Plate 31 has four mounting holes, severally indicated at 32, which are adapted to receive passage of the shank portions of a corresponding plurality of fasteners (not shown), such as bolts or the like, by means of which the plate may be mounted on the door. The improved latch member is shown as being the generally of the butterfly-type shape, and has a substantially-planar side cam surface 33, a convex or rounded upper cam surface 34, a substantially-planar surface 35 extending generally tangentially from the right margin of surface 34, a rounded lug portion 36 extending upwardly from surface 35, a right side surface 38, a tongue 39, and a convex or a rounded portion 40 generated about the pivotal axis 41 and tangentially joining the lower margin of side cam surface 33. A coil spring 42 has its left marginal end portion encircling tongue 39, and acts between the latch member and a similar tab 43 struck outwardly from the plate 31. Spring 42 serves to bias the latch member to move in a counter-clockwise direction until the left surface of lug 36 engages the stop surface 44 of another tab 45 struck outwardly from the plate. A pin 46 mounted on the latch member is constrained to move within a slot 48 provided in the plate. A cotter pin 49 prevents the unintended separation of pin 46 from the slot. A suitable actuation mechanism (not shown) may be operatively arranged to move the latch member to an out-of-the-way position in order that the door might be raised. Upper cam surface 34 is not generated about pivotal axis 41.

Figure 2:
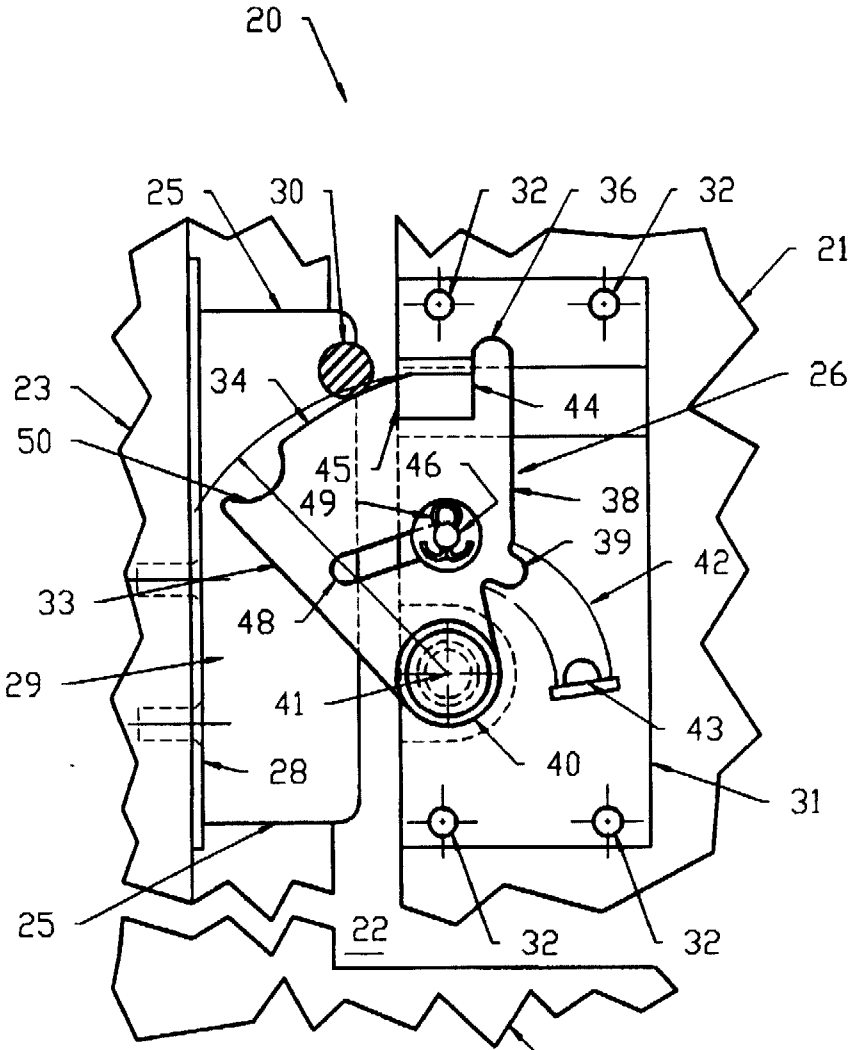
FIG. 2 is a view generally similar to FIG. 1, but showing the latch member as having passed beneath the catch, and as having been rotated in a counter-clockwise direction from the position shown in FIG. 1 such that the upper cam surface of the latch member engages the catch.

When the door is lowered, side cam surface 33 will engage catch 30 and pivot the latch member in a clockwise direction by overcoming the opposing bias provided by spring 42, as shown in FIG. 1. Once the door has been sufficiently lowered, spring 42 will urge the latch member to pivot in a counter-clockwise direction to the position shown in FIG. 2. In this position, catch 30 will engage upper cam surface 34. Thus, if the door attempts move further downwardly relative to the catch, spring 42 will urge the latch member to pivot further in a counter-clockwise direction such that catch 30 will move further up cam 34. Thus, the door is self-tightening.

Figure 3:
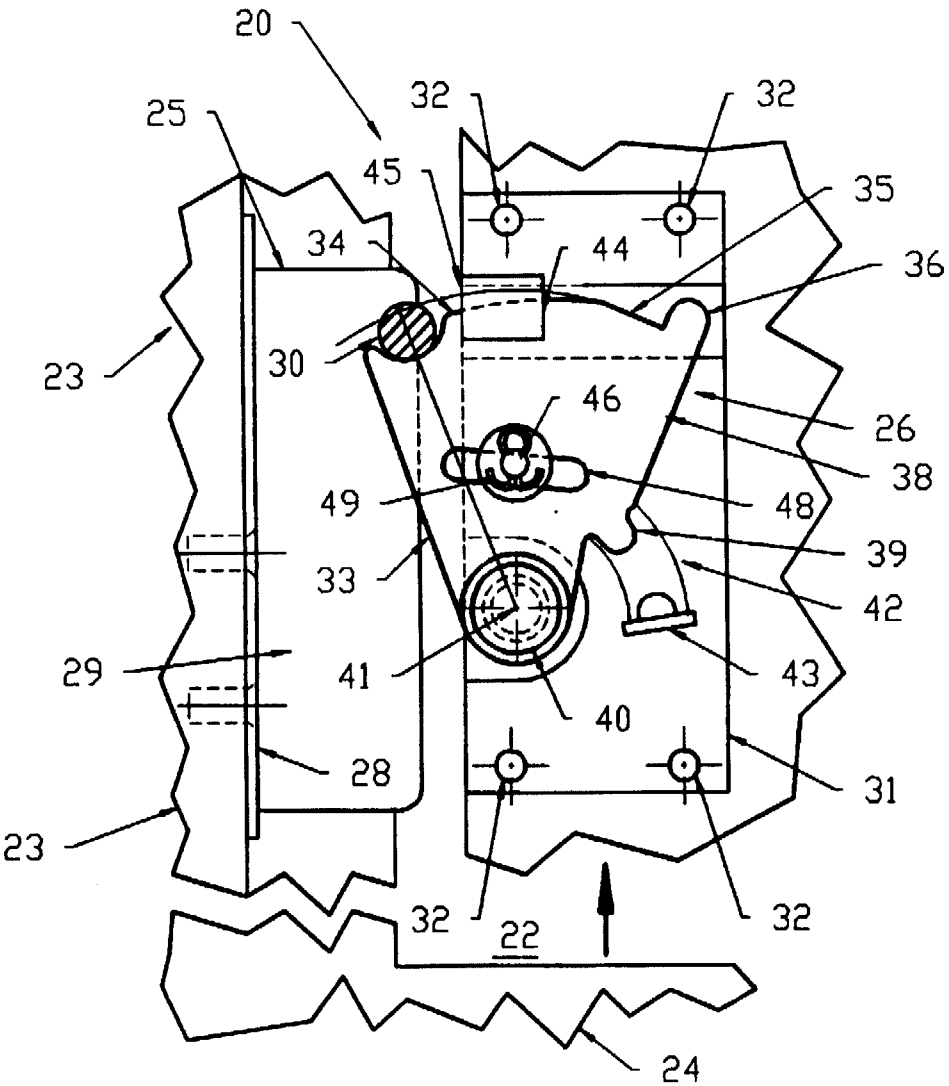
FIG. 3 is a view generally similar to FIG. 2, showing the latch member as having been rotated in a clockwise direction from the position shown in FIG. 2, and showing the catch as being received in the latch member notch to defeat the attempt of a thief to forcibly open the door.

In the preferred embodiment, a notch, generally indicated at 50, is shown as extending radially into the latch member from upper cam surface 34, at a position adjacent side cam surface 33. In the preferred embodiment, this notch 50 is simply a concave recess. However, if a thief attempts to place a crowbar under the door, and attempts to pry the door upwardly, it is possible for cam surface 34 to pivot in a clockwise direction, overcoming the opposing bias of spring 42, toward an out-of-the-way position. However, just before the cam surface might reach this position, the catch will be received in notch 50, as shown in FIG. 3. This will prevent further pivotal motion of the latch member in either lateral direction. Hence, the attempts of the thief will have been defeated.

The present invention contemplates many changes and modifications may be made. For example, the catch may have shapes in forms other than that specifically shown. Similarly, the keeper maybe of other shapes and configurations as well. The latch member need not be configured as the so-called butterfly-type, but may have other shapes or forms as well. In the preferred embodiment, the notch is shown as being concave. However, in other forms, it might have other shapes and configurations as well. For example, it might be U-shaped, V-shaped, or the like. Also, it is preferable that the notch be provided immediately adjacent side cam surface 33 because upper cam surface 34 is not generated about latch member axis 41. This is clearly indicated by the radius in FIGS. 1–3 that is generated about pivotal axis 41. Hence, the presence of the notch in the upper cams surface does not interfere with the normal engagement and disengagement of the side lock mechanism. However, this is not invariable, and maybe changed.

Therefore, while the presently-preferred form of the improved self-tightening side lock mechanism as been shown and described, and several modifications thereof discussed, persons skilled in this art will readily appreciate the various additional changes and modifications maybe made without departing from the spirit of the invention, as defined and differentiated in the following claims.

What is claimed is:

1. A self-tightening side lock in combination with a roll-up door arranged to selectively close an opening bounded by a jamb and a sill, comprising:

a keeper mounted on one of said jamb and door, said keeper having a catch arranged in spaced relation to said jamb and sill; and a latch member pivotally mounted on the other of said jamb and door and selectively cooperable with said catch to hold said door in a closed position with respect to said opening, said latch member being biased to move in one angular direction relative to said jamb and door, said latch member adapted to be moved in the opposite angular direction to an out-of-the-way position at which such displaced latch member may pass by said catch, said latch member having a side cam surface arranged to engage said catch when said door is lowered and to cause said latch member to pivot in said opposite angular direction toward said out-of-the-way position to allow said latch member to pass by said catch, said latch member also having a first convex upper cam surface adjacent said side cam surface and a second convex upper cam surface, said second upper cam surface arranged to engage said catch such that movement of said latch member in said one angular direction will cause said door to be self-tightening, and wherein a concave notch having two ends extends into said latch member adjacent said side cam surface, one of said ends connected to said first upper cam surface and the other of said ends connected to said second upper cam surface, said notch being so configured and arranged as to receive said catch and to prevent further pivotal movement of said latch member relative to said door;

thereby to thwart the efforts of a would-be thief who might attempt to force said door upwardly when said second convex upper cam surface engages said catch.

2. A self-tightening side lock as set forth in claim 1 wherein said keeper is mounted on said jamb and said latch member is mounted on said door.

3. A self-tightening side lock as set forth in claim 1, and further comprising a spring acting between said latch member and said other of said jamb and door for biasing said latch member to move in said one angular direction.

4. A self-tightening side lock as set forth in claim 1 wherein said side cam surface is substantially planar.

5. A self-tightening side lock as set forth in claim 1 wherein each of said upper cam surfaces is arcuate.

6. A self-tightening lock as set forth in claim 1 wherein said upper cam surfaces are generated about an axis not coincident with the pivotal axis of said latch member.

7. A self-tightening side lock as set forth in claim 1 wherein said radius of curvature of said first upper cam surface is the same as the radius of curvature of said second upper cam surface.

8. A self-tightening side lock as set forth in claim 1 wherein said notch extends generally radially into said latch member.

9. A self-tightening side lock in combination with a roll-up door arranged to selectively close an opening bounded by a jamb and a sill, comprising:

a keeper mounted on one of said jamb and door, said keeper having a catch arranged in spaced relation to said jamb and sill;

a latch member pivotally mounted on the other of said jamb and door and selectively cooperable with said catch to hold said door in a closed position with respect to said opening, said latch member being biased to move in one angular direction relative to said jamb and door, said latch member being adapted to be moved in the opposite angular direction to an out-of-the-way position at which such displaced latch member may pass by said catch, said latch member having a side cam surface arranged to engage said catch when said door is lowered and to cause said latch member to pivot in said opposite angular direction toward said out-of-the-way position to allow said latch member to pass by said catch, said latch member also having an upper cam surface which is configured as a convex circular segment having a constant radius and arranged to engage said catch such that movement of said latch member in said one angular direction will cause said door to be self-tightening, and wherein a concave notch having two ends extending into said latch member from said convex upper cam surface adjacent said side cam surface, and said concave notch is bounded at both ends by said convex upper cam surface, said notch being so configured and arranged as to receive said catch and to prevent further pivotal movement of said latch member relative to said door;

thereby to thwart the efforts of a would-be thief who might attempt to force said door upwardly when said convex upper cam surface engages said catch.

10. A self-tightening side lock as set forth in claim 9 wherein said keeper is mounted on said jamb and said latch member is mounted on said door.

11. A self-tightening side lock as set forth in claim 9, and further comprising a spring acting between said latch member and said other of said jamb and door for biasing said latch member to move in said one angular direction.

12. A self-tightening side lock as set forth in claim 9 wherein said side cam surface is substantially planar.

13. A self-tightening side lock as set forth in claim 9 wherein said upper cam surface is arcuate.

14. A self-tightening lock as set forth in claim 9 wherein said upper cam surface is generated about an axis not coincident with the pivotal axis of said latch member.

15. A self-tightening side lock as set forth in claim 9 wherein said notch extends generally radially into said latch member.

* * * * *